US006885359B2

(12) United States Patent
Tsutsui

(10) Patent No.: US 6,885,359 B2
(45) Date of Patent: Apr. 26, 2005

(54) DISPLAY DEVICE WITH SELECTIVE REWRITING FUNCTION

(75) Inventor: Yusuke Tsutsui, Hashima (JP)

(73) Assignee: Sanyo Electric Co., Ltd., Osaka (JP)

( * ) Notice: Subject to any disclaimer, the term of this patent is extended or adjusted under 35 U.S.C. 154(b) by 197 days.

(21) Appl. No.: 10/120,157

(22) Filed: Apr. 11, 2002

(65) Prior Publication Data

US 2002/0154106 A1 Oct. 24, 2002

(30) Foreign Application Priority Data

Apr. 11, 2001 (JP) ..... 2001-112722

(51) Int. Cl.[7] ..... G09G 3/36
(52) U.S. Cl. ..... 345/100
(58) Field of Search ..... 345/87, 88, 89, 345/90, 92, 98, 100, 204, 949, 901, 473; 349/33, 41, 42, 46

(56) References Cited

U.S. PATENT DOCUMENTS 5,712,652 A 1/1998 Sato et al.
5,790,090 A 8/1998 Libsch et al.
5,818,413 A * 10/1998 Hayashi et al. ..... 345/100
5,945,972 A 8/1999 Okumura et al.
5,952,991 A 9/1999 Akiyama
5,977,940 A 11/1999 Akiyama et al.
6,023,308 A 2/2000 Takemura
6,072,454 A 6/2000 Nakai et al.
6,680,721 B1 * 1/2004 Murade et al. ..... 345/94

FOREIGN PATENT DOCUMENTS

| | | |
|---|---|---|
| EP | 0 797 182 | 9/1997 |
| EP | 1 020 840 | 7/2000 |
| JP | 58-23091 | 2/1983 |
| JP | 08-194205 | 7/1996 |
| JP | 09-236823 | 9/1997 |
| JP | 2001-242819 | 9/2001 |

* cited by examiner

*Primary Examiner*—Chanh Nguyen
(74) *Attorney, Agent, or Firm*—Morrison & Foerster LLP

(57) ABSTRACT

A display device has a drain drive circuit, to which a horizontal output enable signal is applied in synchronization with a horizontal scanning signal. The enable signal allows the horizontal scanning signal to be supplied only to the gates of selected sampling transistors. Gate signal lines are also selected by a gate drive circuit. Accordingly, any set of arbitrary pixel elements in the display device are selected for rewriting the signal retained in the pixel elements.

8 Claims, 5 Drawing Sheets

DISPLAY DEVICE WITH SELECTIVE REWRITING FUNCTION

BACKGROUND OF THE INVENTION

1. Field of the Invention

This invention relates to a display device, specifically to a display device which is incorporated into a portable communication and computing device.

2. Description of the Related Art

There has been a great demand in the market for portable communication and computing devices such as a portable TV and a cellular phone. All these devices need a small, light-weight and low-power consumption display device, and efforts have been made accordingly.

FIG. 5 shows a circuit diagram corresponding to a single pixel element of a conventional liquid crystal display device. A gate signal line 51 and a drain signal line 61 are placed on an insulating substrate (not shown) perpendicular to each other. A thin-film transistor (TFT) 72 connected to two signal lines 51, 61, is formed near the intersection of the two signal lines 51, 61. A source 11*s* of the TFT 65 is connected to a display electrode 80 of a liquid crystal 21.

A storage capacitor element 85 holds the voltage of the display electrode 80 during one field period. One terminal 86 of the storage capacitor 85 is connected to the source 11*s* of the TFT 72 and the other terminal 87 is provided with a voltage common among all the pixel elements.

When a scanning signal is applied to the gate signal line 51, the TFT 72 turns to an on-state. Accordingly, an analog image signal from the drain signal line 61 is applied to the display electrode 80, and the storage capacitor 85 holds the voltage. The voltage of the image signal is applied to the liquid crystal 21 through the display electrode 80, and the liquid crystal 21 aligns in response to the applied voltage for providing a liquid crystal display image.

Therefore, this configuration is capable of showing both moving images and still images. There is a need for the display to show both a moving image and a still image within a single display. One such example is to show a still image of a battery within an area of a moving image of a cellular phone display to show the remaining amount of the battery power.

However, the configuration shown in FIG. 6 requires a continuous rewriting of each pixel element with the same image signal at each scanning in order to provide a still image. This is basically to show a still-like image in a moving image mode, and the scanning signal needs to activate the TFT 72 at each scanning.

Accordingly, it is necessary to operate a driver circuit which generates a driver signal for the scanning signals and the image signals, and an external LSI which generates various signals for controlling the timing of the driver circuit, resulting in a significant electric power consumption. This is a considerable drawback when such a configuration is used in a cellular phone device which has only a limited power source. That is, the time a user can use the telephone under one battery charge is considerably decreased.

Japanese Laid-Open Patent Publication No. Hei 8-194205 discloses another configuration for a display device suitable for portable applications. This display device has a static memory for each of the pixel elements, as shown in FIG. 6. A static memory, in which two inverters INV1 and INV2 are positively fed back to each other, holds the image signal. This results in reduced power consumption.

In this configuration, a switching element 24 controls the resistance between a reference line and a display electrode 80 in response to the divalent digital image signal held by the static memory in order to adjust the biasing of the liquid crystal 21. The common electrode, on the other hand, receives an AC signal Vcom. Ideally, this configuration does not need to refresh the memory when the image stays still for a period of time.

As described above, the liquid crystal display device with the static memory for holding the digital image signal is suitable for displaying a low-depth still image with low-power consumption.

However, even if only a part of the displayed image should be changed, as in the case of time display in a liquid crystal display of a portable phone, the digital image signal data for whole image should be sent from the CPU for rewriting the data in the static memory. This also complicates the design of the system, including the liquid crystal display device and the CPU.

SUMMARY OF THE INVENTION

The invention provides a display device including a plurality of drain signal lines for receiving a horizontal scanning signal and a drain drive element for outputting the horizontal scanning signal for selecting one of the drain signal lines. The device also has a plurality of gate signal lines for receiving a vertical scanning signal and a gate drive element for outputting the vertical scanning signal for selecting one of the gate signal lines. A plurality of pixel elements are disposed at locations of the device corresponding to crossings of the drain signal lines and the gate signal lines. These pixel elements form a matrix configuration. A plurality of retaining circuits are disposed for corresponding pixel elements. Each of the retaining circuits holds an image signal fed from one of the drain signal lines. In this configuration, the gate drive element and the drain drive element are configured to select an arbitrary set of pixel elements so that only the image signals retained in the retaining circuits of the selected pixel elements are rewritten.

The invention also provides a display device including a plurality of drain signal lines for receiving a horizontal scanning signal and a drain drive element for outputting the horizontal scanning signal for selecting one of the drain signal lines. The device also includes a plurality of gate signal lines for receiving a vertical scanning signal and a gate drive element for outputting the vertical scanning signal for selecting one of the gate signal lines. A plurality of pixel elements are disposed at locations of the device corresponding to crossings of the drain signal lines and the gate signal lines. The pixel elements form a matrix configuration. A plurality of first display circuits are disposed for the corresponding pixel elements. Each of the first display circuits supplies an image signal inputted from one of the drain signal lines to a display electrode of the pixel element. The first display circuits operate in an analog mode. A plurality of second display circuits are also disposed for corresponding pixel elements. Each of the second display circuits has a retaining circuit for retaining the image signal inputted from one of the drain signal lines and supplies a voltage signal corresponding to the signal retained by the retaining circuit to the display electrode. The device also includes a circuit selection transistor selecting the first display circuit or the second display circuit in response to a circuit selection signal. In this configuration, the gate drive element and the drain drive element are configured to select an arbitrary set of pixel elements so that only the image signals retained in the retaining circuits of the selected pixel elements are rewritten.

Accordingly, the image signals are supplied only to the selected pixel elements, and more flexible design of the display device is possible.

DETAILED DESCRIPTION OF THE INVENTION

This invention is directed to a display device which can alternate between two kinds of display modes, an analog display mode and a digital display mode, as described in commonly owned copending U.S. patent application Ser. No. 09/953,233, entitled "DISPLAY DEVICE AND ITS CONTROL METHOD." The disclosure of U.S. patent application Ser. No. 09/953,233 is, in its entirety, incorporated herein by reference.

Figure 1:
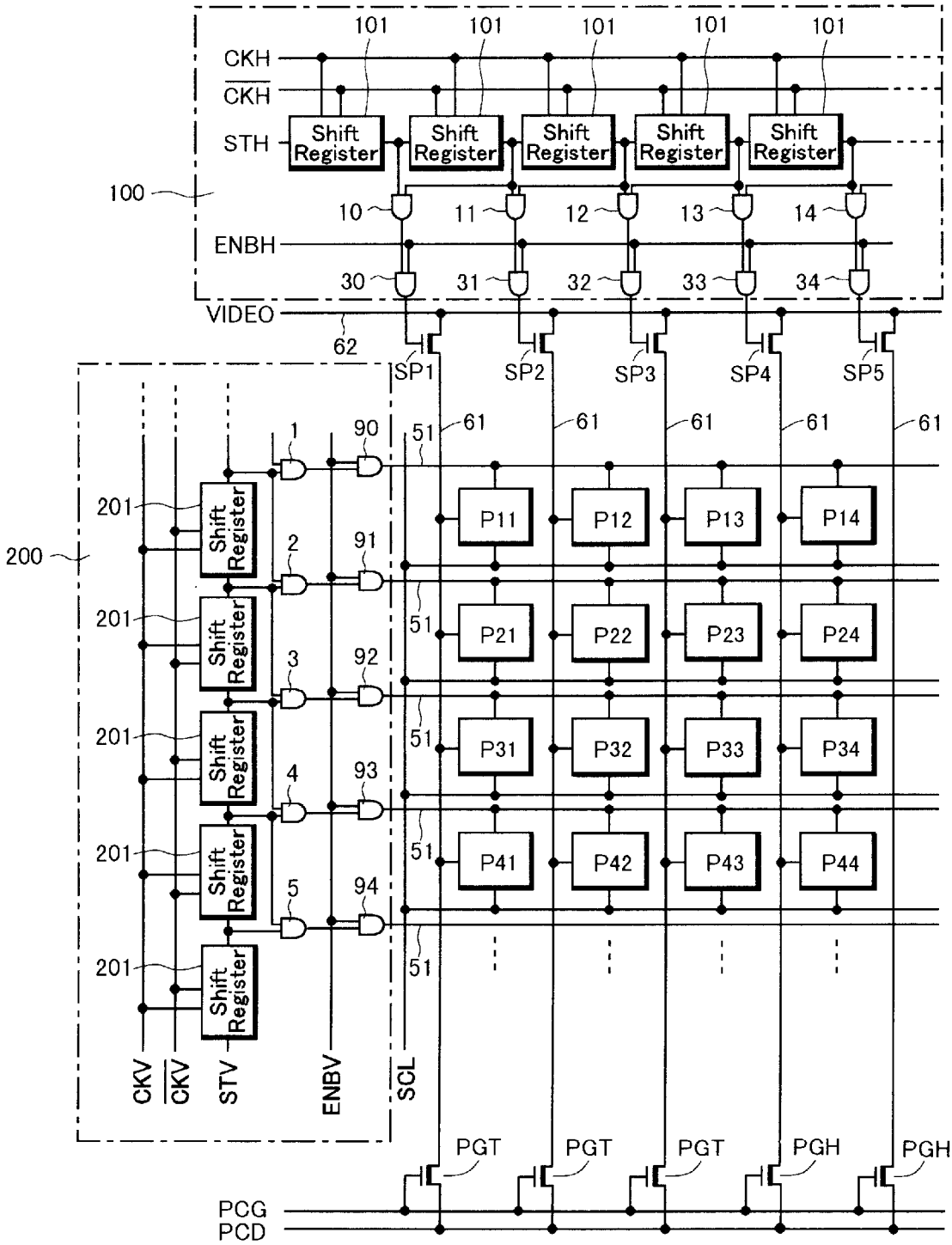
FIG. 1 is a circuit diagram of a liquid crystal display device of an embodiment of this invention.

FIG. 1 shows a circuit diagram of a display device of an embodiment of this invention.

In FIG. 1, on an insulating substrate (not shown), a plurality of drain signal lines 61 are disposed in the vertical direction. And a plurality of gate signal lines 51 are disposed in the horizontal direction. Pixel elements P11, P12, P13 - - - , are disposed corresponding to each crossing of the drain signal lines and the gate signal lines.

A drain drive circuit 100 sequentially supplies a horizontal scanning signal to a group of N channel sampling transistors SP1, SP2, SP3—formed at one end of the drain signal line 61. For example, when the sampling transistor SP1 receives a horizontal scanning signal of "H", the SP1 turns on and an image signal is applied to the drain signal line 61 through the Sp1.

Basically, the drain drive circuit 100 comprises a plurality of shift registers 101 connected to each other, to which horizontal standard clocks CKH and *CKH (the inverted clock of the CKH) are applied. Also, the horizontal scanning signal is sequentially generated from a group of AND gates 10, 11, 12, 13, 14, - - - based on a horizontal start signal STH. The horizontal scanning signal is inputted to one of the input terminals of the group of AND gates 30, 31, 32, 33, 34, - - - . To the other input terminals of the group of AND gates 30, 31, 32, 33, 34, - - - , the horizontal output enable signal ENBH is commonly applied.

Figure 2:
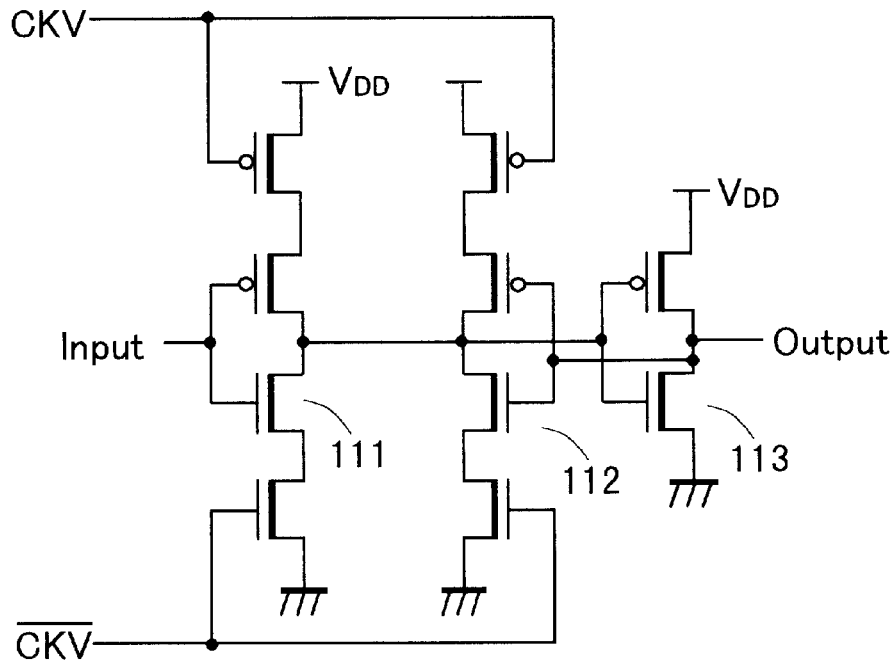
FIG. 2 is a circuit diagram of a shift register of the embodiment of FIG. 1.

A shift register 101, as seen in FIG. 2, comprises clocked inverters 110, 111, to which the horizontal standard clocks CKH, *CKH are applied, and an inverter 121.

Therefore, by adding the horizontal output enable signal ENBH in synchronization with the timing of the horizontal scanning signal sequentially generated from the group of AND gates 10, 11, 12, 13, 14, - - - , it is possible to selectively supply the horizontal scanning signal to the gates sampling transistors SP1, SP2, SP3, - - - and arbitrarily select the drain signal line 61 for writing the image signal.

The gate drive circuit 200 has the same configuration as the drain drive circuit 100. The gate drive circuit 200 comprises a plurality of shift registers 201 connected to each other, to which vertical standard clocks CKV and *CKV (the inverted clock of the CKV) are applied. Also, the vertical scanning signal is sequentially generated from a group of AND gates 1, 2, 3, 4, 5, - - - , based on a vertical start signal STH.

The vertical scanning signal is inputted to one of input terminals of the group of AND gates 90, 91, 92, 93, 94, - - - . To the other input terminals of the group of AND gates 90, 91, 92, 93, 94, - - - , a vertical output enable signal ENBV is commonly applied.

Therefore, by adding the vertical output enable signal ENBV, it is possible to selectively supply the vertical scanning signal to the gate signal line 51.

At the other end of each of the drain signal lines 61, a pre-charging transistor PGT is formed. At the source of this pre-charging transistor, a predetermined level of voltage PCD is applied. The pre-charging transistor PGT pre-charges the drain signal line to the predetermined level of voltage PCD in response to the pre-charging signal PCG applied to the gate before the drain drive circuit 100 outputs the horizontal scanning signal.

In the configuration of the liquid crystal display device described above, when the gate drive circuit 200 selects one gate signal line 51, all the display pixel elements in one horizontal line are also selected. Then, the pixel element selection TFT 72 turns on, and the voltage at the drain signal line 61 not selected by the drain drive circuit 100 is left undetermined. When the driving ability of the inverter INV2 of the retaining circuit 110 is low compared to the parasitic capacitance of the drain signal line 61, there is a possibility that the data retained in the retaining circuit 110 is lost.

Thus, before the drain drive circuit 100 outputs the horizontal scanning signal, the inverter INV2 of the retaining circuit 110 obtains a supplemental driving ability due to pre-charging the drain signal line to the predetermined level of voltage PCD. This eliminates the possibility of loosing the data retained in the retaining circuit 110. When the power voltage supplied to the retaining circuit 110 is VDD, it is preferable that the predetermined level of voltage PCD is about VDD/2.

Figure 3:
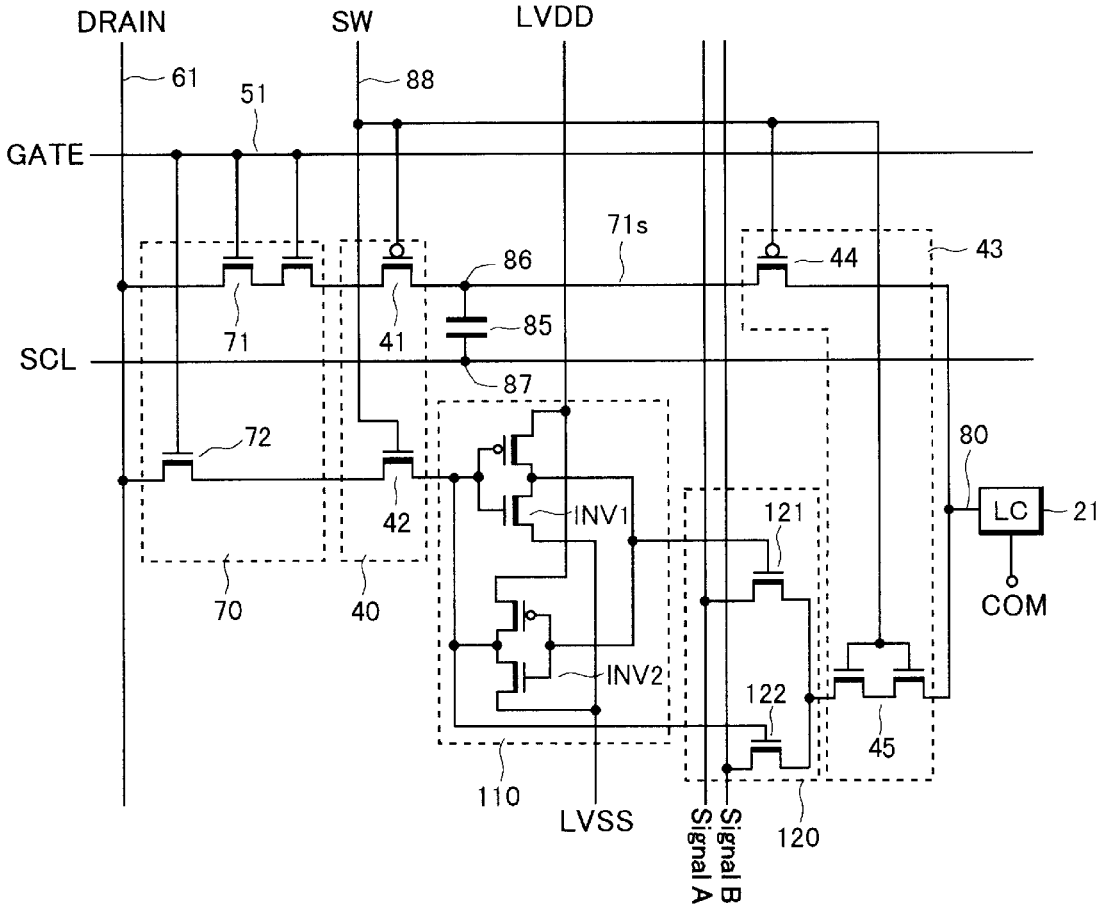
FIG. 3 is a circuit diagram of the pixel element of the embodiment of FIG. 1.

FIG. 3 shows the circuit diagram of one pixel element (for example, P11). Near the crossing of the gate signal line 51 and drain signal line 61, a circuit selection circuit 40 having a P channel TFT 41 and an N channel TFT 42 is formed. Both drains of the TFTs 41 and 42 are connected to the drain signal line 61 and both gates of these TFTs are connected to a circuit selection signal line 88. Either one of TFTs 41 or 42 turns on based on a selection signal from the circuit selection signal line 88. Also, as explained later, a pair of circuit selection circuits 40, 43, are provided.

Also, a pixel element selection circuit 70 having an N channel TFT 71 and an N channel TFT 72 is formed adjacent to the circuit selection circuit 40. The TFTs 71, 72 turn on based on the scanning signal fed from the gate signal line 51.

A storage capacitance element 85 for holding the analog image signal for one field period is formed in the pixel element. One electrode 86 of the storage capacitance element 85 is connected to the source 71*s* of the TFT 71. Another electrode 87 is connected to a storage capacitance line SCL commonly used among all the pixel elements and provided with a certain bias voltage.

A P channel TFT 44 of the circuit selection circuit 43 is placed between the storage capacitance element 85 and the liquid crystal 21, and turns on and off in synchronization with the switching of the TFT 41 of the circuit selection circuit 43. A retaining circuit 110 and a signal selection circuit 120 are placed between the TFT 72 of the pixel element selection circuit 70 and the display electrode 80 of the liquid crystal 21.

The retaining circuit 110 is a static memory having two inverter circuits, the first and second inverter circuits, which are positively fed back to each other. Under the digital display mode, when the voltage of the circuit selection signal line 88, as well as the scanning signal of the gate signal line 51, is "H", the digital image signal inputted from the drain signal line 61 is written into the retaining circuit 110.

The signal selection circuit 120 is the circuit selecting the signal based on the digital image signal retained in the static memory circuit 110 and has two N-channel TFTs 121, and 122. To the gates of the TFTs 121, 122, the output signal is complimentarily supplied from the static memory circuit 110 and thus, the TFTs 121, 122 complimentarily turn on and off. When TFT 122 turns on, the signal A (black signal) is selected. When the TFT 121 turns on, signal B (white signal) is selected. Then, the selected signal is supplied to the display electrode 80, which applies the voltage to the liquid crystal 21, through the TFT 45 of the circuit selection circuit 43. Therefore, in the above configuration, switching between the analog display mode and the digital display mode (low power consumption, for still image display) is possible.

Figure 4:
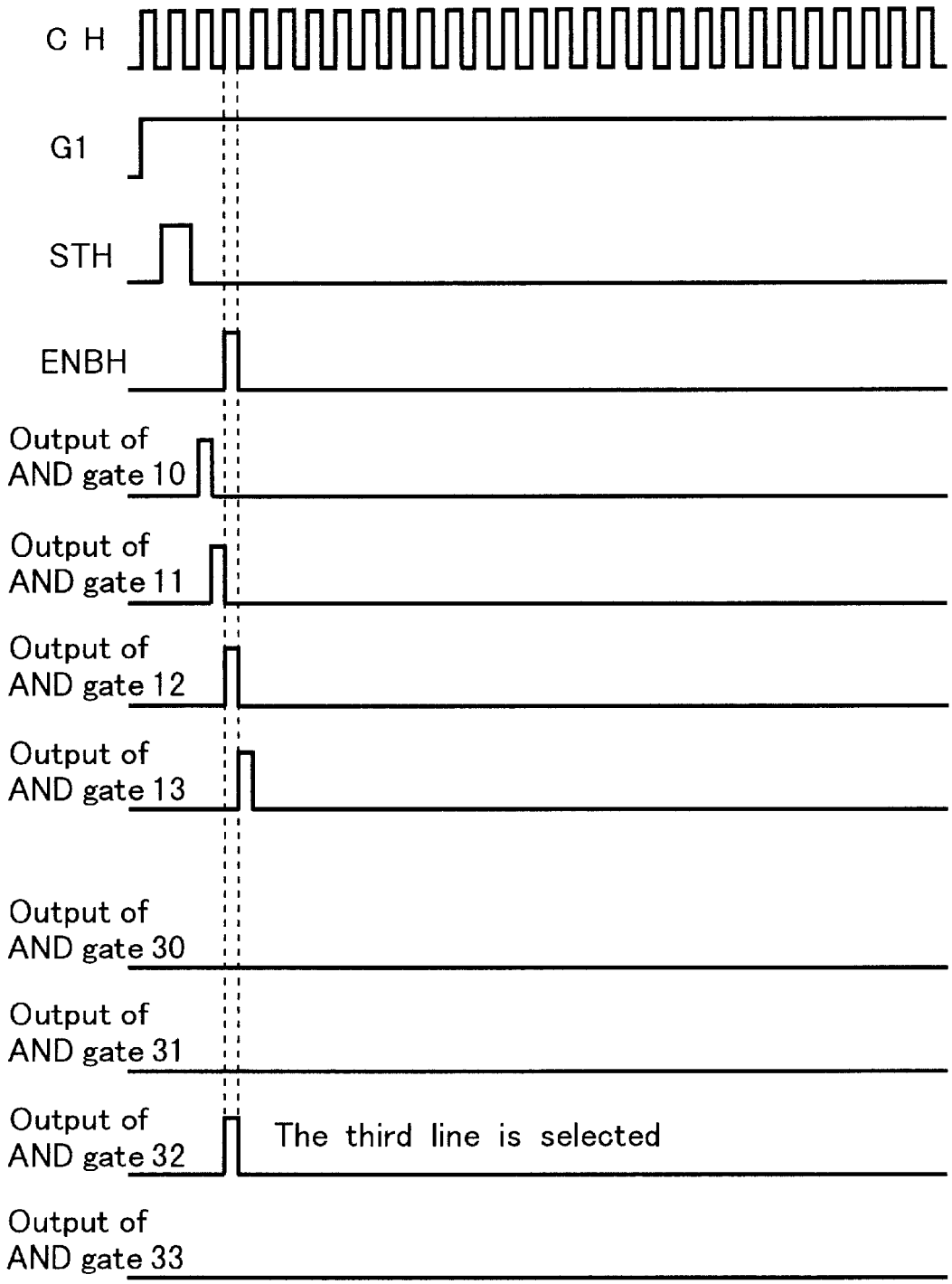
FIG. 4 is a timing chart showing operation of the liquid crystal display device of the embodiment of FIG. 1.
Figure 5:
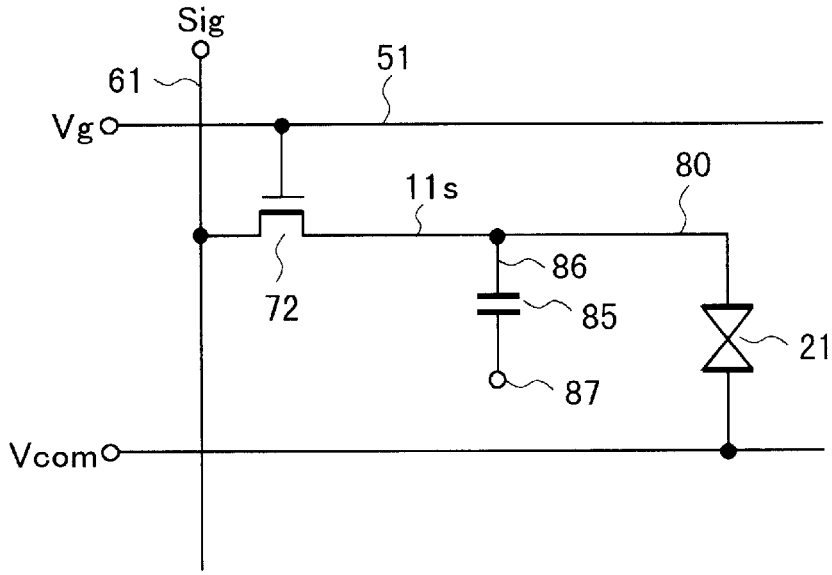
Fig.5 PRIOR ART
FIG. 5 is a circuit diagram of a conventional liquid crystal display device.
Figure 6:
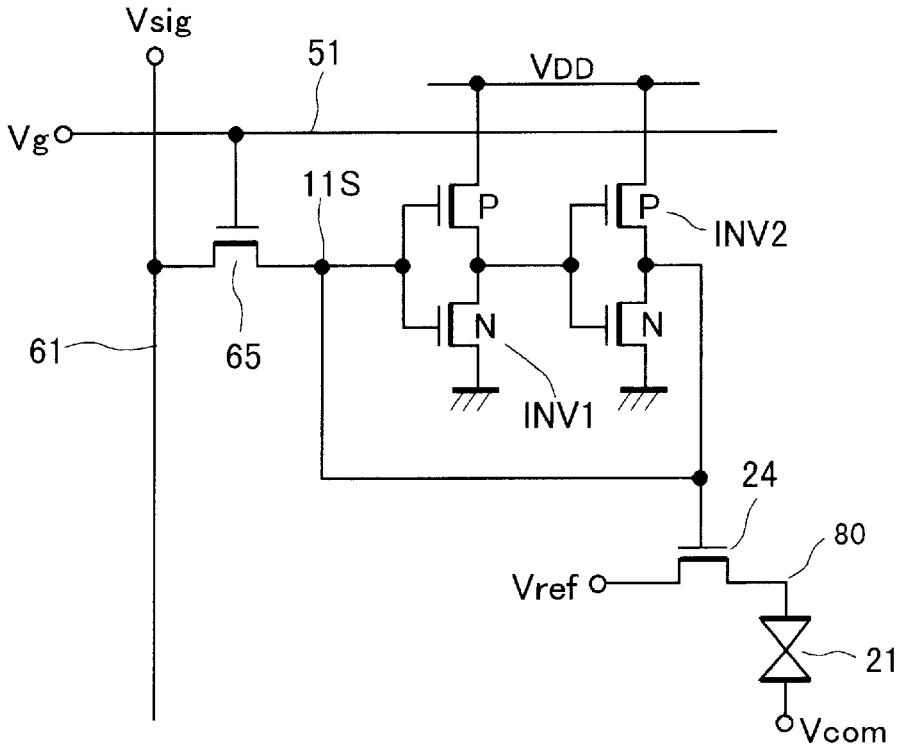
Fig.6 PRIOR ART
FIG. 6 is a circuit diagram of another conventional liquid crystal display device.

Next, the operation of the liquid crystal display device of above configuration will be explained by referring to FIGS. 1 and 4. Here, the operation under the digital display mode will be explained. That is, the voltage of the circuit selection signal line 88 is "H" and the retaining circuit 110 is ready for writing. Also, all the drain signal lines 61 are pre-charged by the pre-charging transistor PGT before the horizontal scanning signal is outputted.

When the drain drive circuit 100 starts its operation with the horizontal start signal STH as a trigger pulse, the group of AND gates 10, 11, 12, 13, - - - sequentially generate pulses of the horizontal scanning signals. For example, by making the horizontal output enable signal "H" in the synchronization with the timing of the horizontal scanning signal pulse outputted from the AND gate 12, the horizontal scanning pulse from other AND gates 10, 11, 13, - - - will be masked. Thus, the horizontal scanning pulse only from the third AND gate 12 is outputted. Therefore, only the drain signal line 61 on the third line is selected and the digital image signal is fed to that drain signal line 61 through the sampling transistor SP3.

Suppose the gate drive circuit 200 selects the first line of the gate signal line 51. Then, the digital image signal is written into the pixel element P13. In this manner, it is possible to rewrite the image signal data by selecting any arbitrary pixel element. The selection of the pixel element is not limited to the selection of only one pixel element. By controlling the output timing of the horizontal output enable signal ENBH at the drain drive circuit 100 and the output timing of the vertical output enable signal ENBV at the gate drive circuit 200, rewriting of a block of data is also possible.

After the rewriting of data into the retaining circuit 110, the display (still picture) based on the data retained in the retaining circuit 110 is made. That is, when the retaining circuit 110 is provided with the power voltage VDD, and when the common electrode voltage VCOM is applied to the common electrode, the liquid crystal display panel 100 is in the normally-white (NW) mode. In this mode, the same voltage as the common electrode 32 (VCOM) is applied to the signal A and the display voltage for making the black display is applied to the signal B. In this way, the data for one still picture is retained and displayed.

When the digital image signal of "H" is written into the retaining circuit 110, the first TFT 121 receives an "L" signal and, accordingly, turns off. The second TFT 122 receives a "H" signal and turns on at the signal selection circuit 120. In this case, the signal B is selected and applied to the liquid crystal. That is, the display voltage of the signal B having a phase opposite to the signal A is applied, resulting in rearrangement of the liquid crystal 21. Since the display panel is in an NW mode, a black image results.

When the digital image signal of "L" is written into the retaining circuit 110, the first TFT 121 receives an "H" signal and, accordingly, turns on. The second TFT 122 receives a "L" signal and turns off at the signal selection circuit 120. In this case, the signal A is selected and applied to the liquid crystal 21. That is, the liquid crystal is provided with the same voltage applied to the common electrode 32. As a result, there is no change in the arrangement of the liquid crystal 21 and the display element stays white.

Next, the operation of the display device under the analog display mode will be explained. When the circuit selection signal line 88 receives "L", the TFTs 41, 44 of the circuit selection circuits 40, 43 turn on. Also, based on the horizontal start signal STH, the sampling transistor SP (not shown in the figure) turns on in response to the sampling signal. Then, the analog image signal is applied to the drain signal line 61. Also, the scanning signal is applied to the gate signal line 51 based on the vertical start signal STV.

When pixel element selection TFT 72 turns on in response to the scanning signal, the analog image signal is transmitted to the display electrode 80 from the drain signal line 61 and also retained in the storage capacitance element 85. The image signal voltage applied to the display electrode 80 is then applied to the liquid crystal 21. Based on this voltage the liquid crystal 21 aligns itself, resulting in the liquid crystal display. The analog display mode is suitable for showing the full color moving picture.

In the above embodiment, the retaining circuit is configured so that the one-bit digital image signal is inputted. However, this invention is not limited to this configuration. This invention is also applicable to a retaining circuit with a multiple-bit configuration, by which the writing and retention of a plurality of digital image signals are possible. Therefore, the fine display with multi-gray scale is possible.

According to the display device of this invention, the rewriting of the image signal is possible (that is, the random access is possible) by selecting any set of arbitrary pixel elements in the display device. Therefore, it is not necessary to supply the image signal to all the pixel elements.

Additionally, since the drain signal line, which receives the image signal, has already been pre-charged to a predetermined voltage level, the voltage retained in the retaining circuit will not be lost.

The above is a detailed description of the particular embodiment of the invention which is not intended to limit the invention to the embodiment described. It is recognized that modifications within the scope of the invention will occur to a person skilled in the art. Such modifications and equivalents of the invention are intended for inclusion within the scope of this invention.

What is claimed is:

1. A display device comprising:

a plurality of drain signal lines;

a drain drive element outputting a horizontal scanning signal for selecting one of the drain signal lines;

a plurality of gate signal lines;

a gate drive element outputting a vertical scanning signal for selecting one of the gate signal lines;

a plurality of pixel elements provided at locations of the device corresponding to crossings of the drain signal lines and the gate signal lines, the pixel elements forming a matrix configuration; and a plurality of retaining circuits provided for corresponding pixel elements, the retaining circuits each holding an image signal fed from one of the drain signal lines, wherein the gate drive element and the drain drive element are configured to select an arbitrary set of pixel elements so that only the image signals retained in the retaining circuits of the selected pixel elements are rewritten, and the drain drive element comprises a shift register generating the horizontal scanning signal in response to a horizontal start signal and a horizontal output enable element receiving the horizontal scanning signal from the shift register and outputting the horizontal scanning signal to one of the drain signal lines corresponding to the selected pixel elements in response to a horizontal output enable signal which is in synchronization with the reception of the the horizontal scanning signal of the one of the drain signal lines corresponding to the selected pixel elements.

2. The display device of claim 1, wherein the gate drive element comprises a shift register generating the vertical scanning signal in response to a vertical start signal and a vertical output enable element outputting to one of the gate signal lines corresponding to the selected pixel elements the vertical scanning signal in response to a vertical output enable signal.

3. The display device of claim 2, further comprising a pre-charging element pre-charging the drain signal lines to a predetermined voltage level before the drain drive element outputs the horizontal scanning signal.

4. The display device of claim 3, wherein the predetermined of voltage level is approximately half of a power voltage supplied to the retaining circuit.

5. A display device comprising:

a plurality of drain signal lines;

a drain drive element outputting a horizontal scanning signal for selecting one of the drain signal lines;

a plurality of gate signal lines;

a gate drive element outputting a vertical scanning signal for selecting one of the gate signal lines;

a plurality of pixel elements provided at locations of the device corresponding to crossings of the drain signal lines and the gate signal lines, the pixel elements forming a matrix configuration;

a plurality of first display circuits provided for corresponding pixel elements, each supplying an image signal inputted from one of the drain signal lines to a display electrode of the corresponding pixel element, the first display circuits operating in an analog mode;

a plurality of second display circuits provided for corresponding pixel elements, the second display circuits each having a retaining circuit retaining the image signal inputted from the drain signal line and each supplying a voltage signal corresponding to the signal retained by the retaining circuit to the display electrode; and a circuit selection transistor selecting the first display circuit or the second display circuit in response to a circuit selection signal, wherein the gate drive element and the drain drive element are configured to select an arbitrary set of pixel elements so that only the image signals retained in the retaining circuits of the selected pixel elements are rewritten, and the drain drive element comprises a shift register generating the horizontal scanning signal in response to a horizontal start signal and a horizontal output enable element receiving the horizontal start signal from the shift register and outputting the horizontal scanning signal to one of the drain signal lines corresponding to the selected pixel elements in response to a horizontal output enable signal which is in synchronization with the reception of the horizontal scanning signal of the one of the drain signal lines corresponding to the selected pixel elements.

6. The display device of claim 5, wherein the gate drive element comprises a shift register generating the vertical scanning signal in response to a vertical start signal and a vertical output enable element outputting to one of the gate signal lines corresponding to the selected pixel elements the vertical scanning signal in response to a vertical output enable signal.

7. The display device of claim 6, further comprising a pre-charging element for pre-charging the drain signal lines to a predetermined voltage level before the drain drive element outputs the horizontal scanning signal.

8. The display device of claim 7, wherein the predetermined voltage level is approximately a half of a power voltage supplied to the retaining circuit.

* * * * *